US005899662A

United States Patent [19]

Hojyo et al.

[11] Patent Number: 5,899,662

[45] Date of Patent: May 4, 1999

[54] FLOW PATH STRUCTURE IN WATER PUMP

[75] Inventors: Atuo Hojyo; Makoto Harada; Fumiaki Okubo; Toshiyasu Murano, all of Saitama, Japan

[73] Assignee: Honda Giken Kogyo Kabushiki Kaisha, Tokyo, Japan

[21] Appl. No.: 08/884,626

[22] Filed: Jun. 27, 1997

[30] Foreign Application Priority Data

Jun. 28, 1996 [JP] Japan ..... 8-168868

[51] Int. Cl.[6] ..... F04D 29/40

[52] U.S. Cl. ..... 415/206; 415/204; 415/268.1

[58] Field of Search ..... 415/206, 204, 415/208.1

[56] References Cited

U.S. PATENT DOCUMENTS 2,618,223 11/1952 Ransohoff ..... 415/204

4,549,848 10/1985 Wallman ..... 415/206

5,100,288 3/1992 Stanislao ..... 415/206

5,779,444 7/1998 Onigata et al. ..... 415/206

*Primary Examiner*—Christopher Verdier

*Assistant Examiner*—Richard Woo

*Attorney, Agent, or Firm*—Birch, Stewart, Kolasch & Birch, LLP

[57] ABSTRACT

A water pump for feeding water under the action of centrifugal force created by rotation of an impeller disposed within a pump case includes a cooling water discharge port formed at a position offset in the axial direction of the pump from the outer peripheral portion of the impeller. A flow path structure having a projecting portion for guiding cooling water from the outer peripheral portion of the impeller up to the discharge port is intended to provide a flow path structure capable of smoothing the flow of cooling water, thereby increasing the amount of cooling water discharged and improving the pumping performance.

16 Claims, 8 Drawing Sheets

FLOW PATH STRUCTURE IN WATER PUMP

BACKGROUND OF THE INVENTION

1. Field of the Invention

The present invention relates to a water pump, and in particular, to a water pump used in the cooling system of an internal combustion engine on a vehicle.

2. Description of the Background Art

Various water pumps are known in which a cooling water discharge port is formed in the outer peripheral portion of an impeller adapted to rotate within a pump case. For example, in Japanese Utility Model Laid Open No. 60095/88, cooling water which is fed to the outer peripheral portion of the impeller by virtue of centrifugal force created by rotation of the impeller is discharged directly from the discharge port.

However, certain vehicle body layouts may not permit formation of the discharge port at the outer peripheral portion of the impeller. Therefore, the discharge port must be formed at a position offset in the axial direction of the pump from the outer peripheral portion of the impeller. An example of such a case is shown in FIG. 9.

FIG. 9 is a vertical sectional view of a water pump 101. The water pump 101 has a pump case including a pump body 102 and a pump cover 103.

The pump body 102 has a cylindrical portion 102*a* which supports a pump shaft 106 rotatably through a bearing 105. A bowl-like portion 102*b* is expanded radially from an end of the cylindrical portion 102*a* so as to cover about half of an impeller 107 which is fitted on an end portion of the pump shaft 106.

The pump cover 103 is brought into abutment with the bowl-like portion 102*b* of the pump body 102 through mating surfaces of the two to cover the remaining half of the impeller 107. The pump cover 103 has a suction port 103*a* formed toward the center of the impeller 107, and a discharge port 103*b* formed at a position offset in the axial direction of the pump from the outer peripheral portion of the impeller 107.

When the pump shaft 106 is rotated by operation of an internal combustion engine (not shown), the impeller 107 rotates together with the pump shaft 106, whereby cooling water is sucked into the central portion of the impeller 107 through the suction port 103*a*. The cooling water is then directed to the outer peripheral portion of the impeller 107 by. virtue of centrifugal force generated due to rotation of the impeller 107. The cooling water then passes through a passageway 108 which is bent approximately at a right angle. Thereafter, the cooling water travels to the discharge port 103*b* located at the offset position, and is then discharged.

In the conventional water pump where the discharge port is located at a position offset in the axial direction of the pump from the outer peripheral portion of the impeller, as mentioned above, the passageway 108 causes the flow of cooling water to bend at a right angle in the area from the outer peripheral portion of the impeller 107 up to the discharge port 103*b*. Consequently, the cooling water directed to the outer peripheral portion of the impeller 107 by the centrifugal force of the impeller is bent abruptly in the axial direction of the pump, so that the flow in the passageway 108 is disturbed and is not smoothly transported to the discharge port 103*b*.

SUMMARY OF THE INVENTION

It is an object of the present invention to provide a flow path structure in a water pump having a discharge port at a position offset in the axial direction of the pump from the outer peripheral portion of an impeller.

It is a further object of the present invention to provide a flow path structure which makes it possible to smooth the flow of cooling water and thereby increase the amount of cooling water discharged and improving the pumping performance.

According to the present invention, in order to achieve the above-mentioned-object, there is provided a flow path structure in a water pump for feeding water by virtue of a centrifugal force created by rotation of an impeller disposed within a pump case, with a cooling water discharge port being formed at a position offset in the axial direction of the pump from the outer peripheral portion of the impeller, wherein a projecting portion is provided for guiding the cooling water to the discharge port from the outer peripheral portion of the impeller.

By such a simple structure as the formation of a projecting portion for guiding the cooling water from the outer peripheral portion of the impeller to the cooling water discharge port, the cooling water, which is directed to the outer peripheral portion of the impeller under the action of a centrifugal force created by rotation of the impeller, is guided along the projecting portion up to the discharge port. Consequently, the cooling water flows smoothly without causing a turbulent flow and is discharged from the discharge port. In this way, the amount of cooling water discharged is increased, and the pumping performance is improved.

In the flow path structure according to the present invention, by forming the projecting portion so as to have a gently curved side face, the cooling water directed to the outer peripheral portion of the impeller is guided along the gently curved side face of the projecting portion up to the discharge port, so that a more smooth flow of the cooling water can be ensured.

In the flow path structure according to the present invention, the pump case is split in half along the outer peripheral portion of the impeller. The projecting portion is formed on one case half of the case along the outer peripheral portion of the impeller to define a flow path for guiding cooling water to the discharge port which is formed in the other case half. This arrangement allows the pump case to be more easily fabricated and mounted.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention will now be described in detail below, with particular reference to FIGS. 1 to 6.

Figure 1:
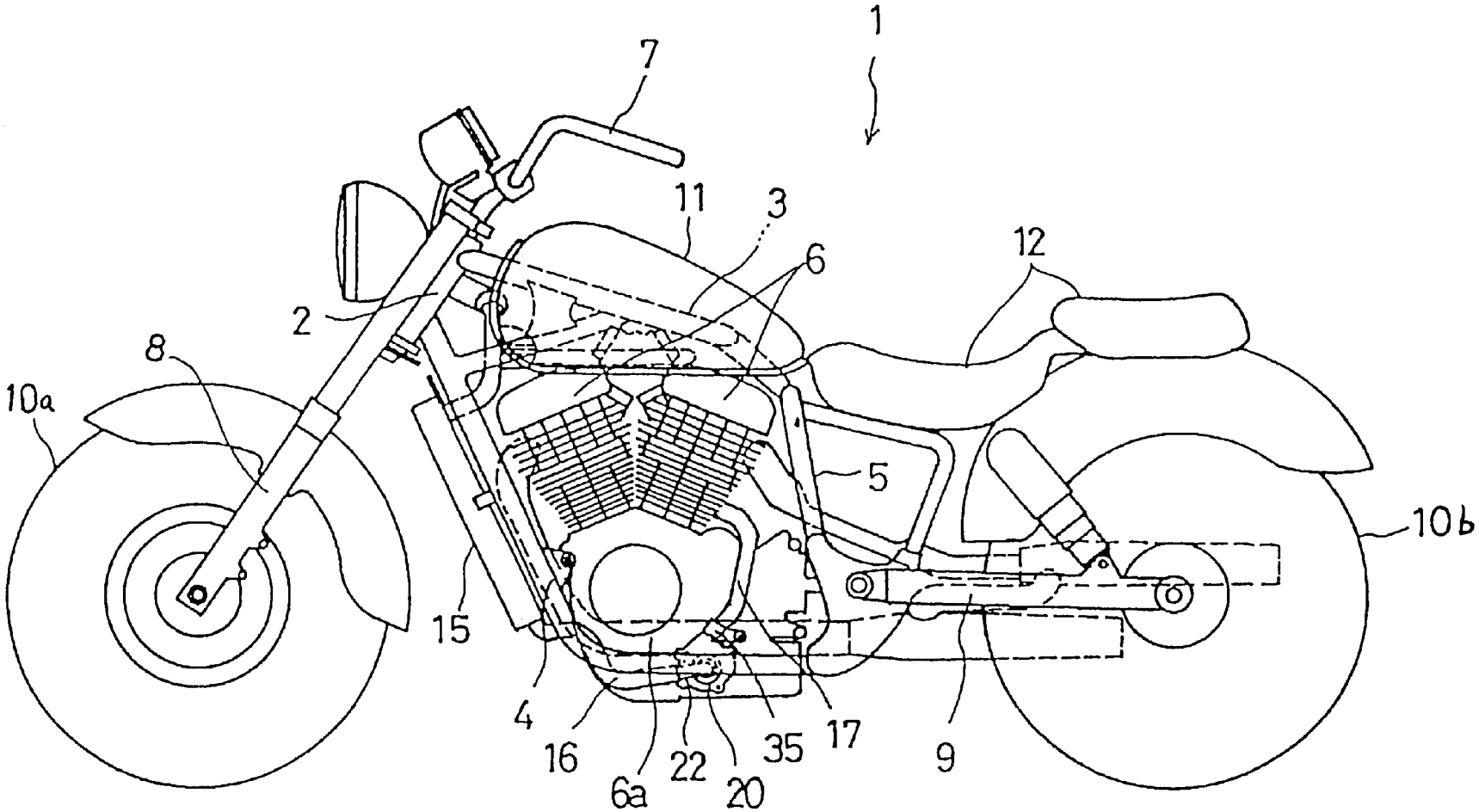
FIG. 1 is a side view of a two-wheeled motor vehicle utilizing the present invention.
Figure 2:
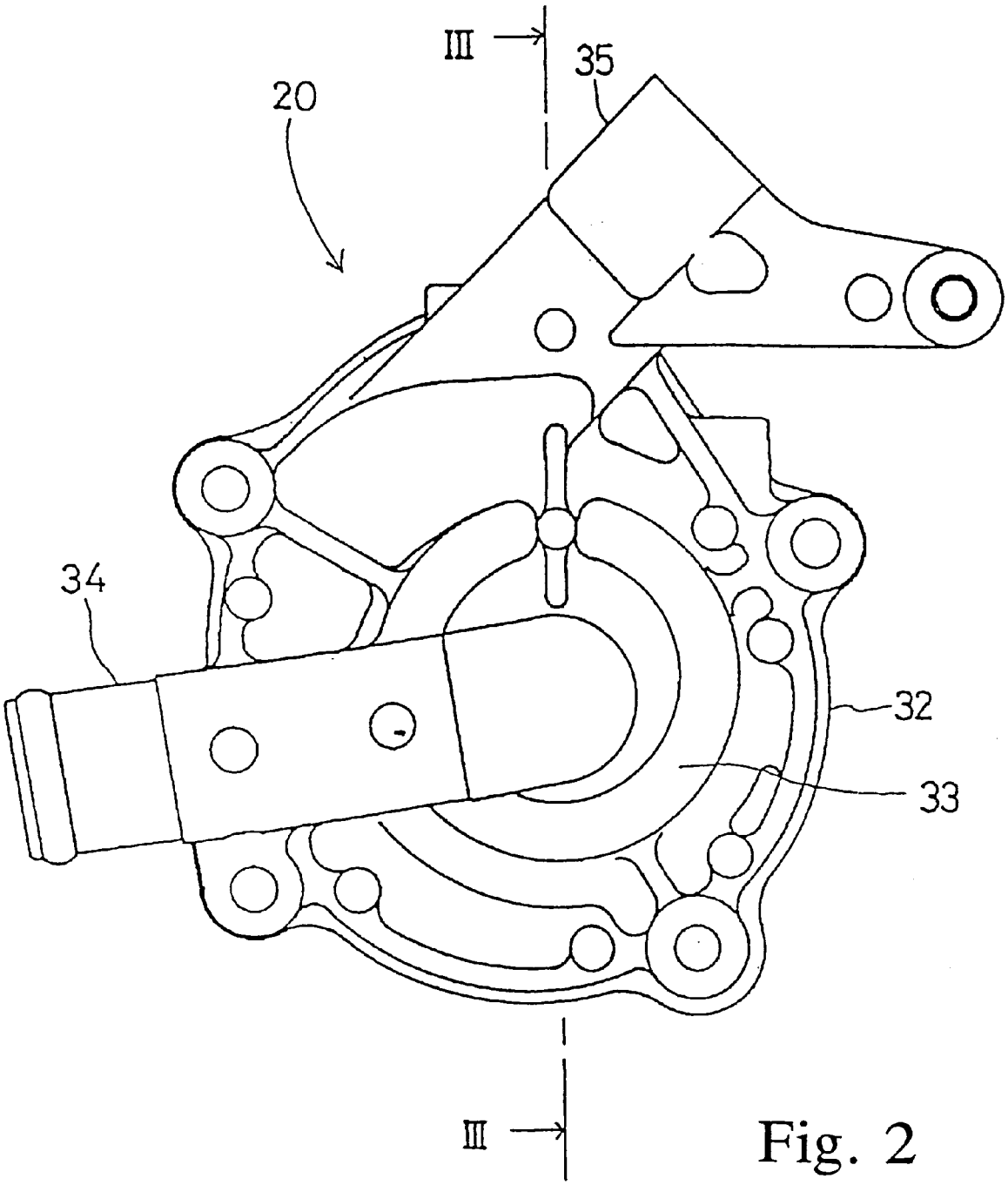
FIG. 2 is an end view of a water pump case according to a first embodiment.

The present invention is applied to a two-wheeled motor vehicle 1, of the type shown in FIG. 1. In the two-wheeled motor vehicle 1, main pipes 3 extend rearwardly from the upper portion of a head pipe 2, while down pipes 4 extend obliquely downwardly from the lower portion of the head pipe 2, and then bend rearwardly in a substantially horizontal direction. The rear ends of the down pipes 4 and the rear ends of the main pipes 3 are connected together through a center frame 5 to constitute a body frame of the vehicle.

Centrally of the body frame is mounted a water-cooled type, two-cylinder, four-stroke, internal combustion engine 6, which is V-shaped in the longitudinal direction.

A steering shaft is supported swingably by the head pipe 2, and a handle 7 is provided at the upper portion of the steering shaft so as to extend right and left. A pair of the front forks 8 extend downwardly from the steering shaft, and a pair of rear forks 9 include front ends which are pivoted to the lower portion of the center frame 5 in a vertically swingable manner.

A front wheel 10*a* is pivotally connected to the lower ends of the front forks 8, and a rear wheel 10*b* is pivotally connected to the rear ends of the rear forks 9.

A fuel tank 11 is supported by the main pipes 3, and a seat 12 is disposed behind the fuel tank 11.

A radiator 15 is attached to the front sides of the down pipes 4, and a cooling water hose 16 extends from the lower portion of the radiator 15. A water pump 20 is mounted to the lower portion of a left-hand crankcase 6*a* of the internal combustion engine 6.

The cooling water hose 16 is connected to a suction pipe 34 of the water pump 20. A cooling water hose 17 is connected at one end to a discharge pipe 35 of the water pump 20, and at an opposite end to a water jacket formed in the cylinder block of the internal combustion engine 6.

The structure of the water pump 20 will now be described below, with particular reference to FIGS. 2 to 6.

The water pump 20 has a pump case formed by a pump body 21 and a pump cover 31. A right-hand mating surface of the pump cover 31 is brought into abutment with a left-hand mating surface of the pump body 21, and then both are fixed together with bolts.

Figure 6:
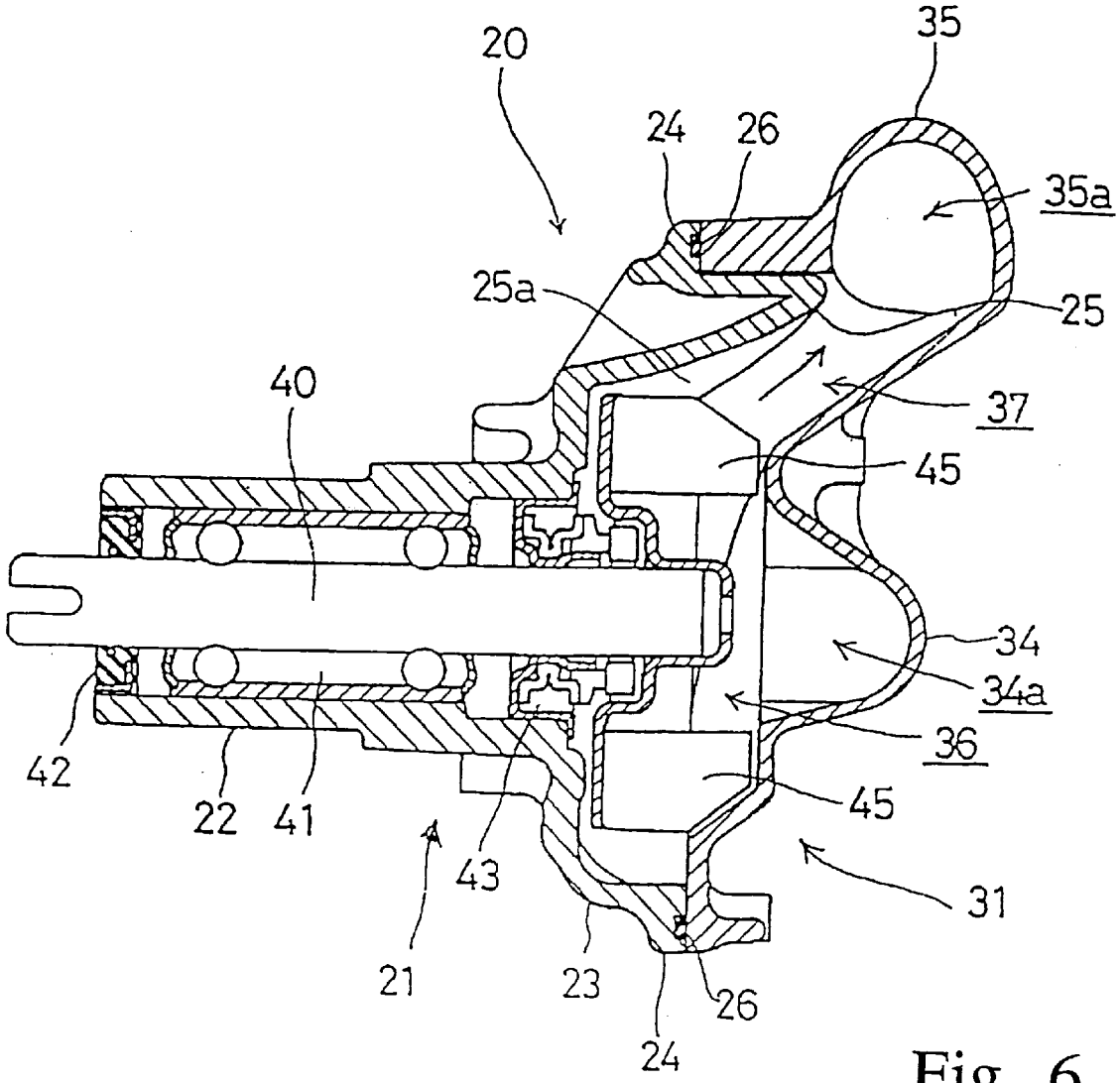
FIG. 6 is a sectional view of the water pump with a pump shaft and an impeller incorporated therein.

The pump body 21 includes a cylindrical portion 22 which rotatably supports a pump shaft 40 therein (see FIG. 6). The pump body 21 further includes a bowl-like portion 23 extending radially outwardly from one end of the cylindrical portion 22. The bowl-like portion 23 covers about half of an impeller 45 (see FIG. 6) located therein.

Figure 3:
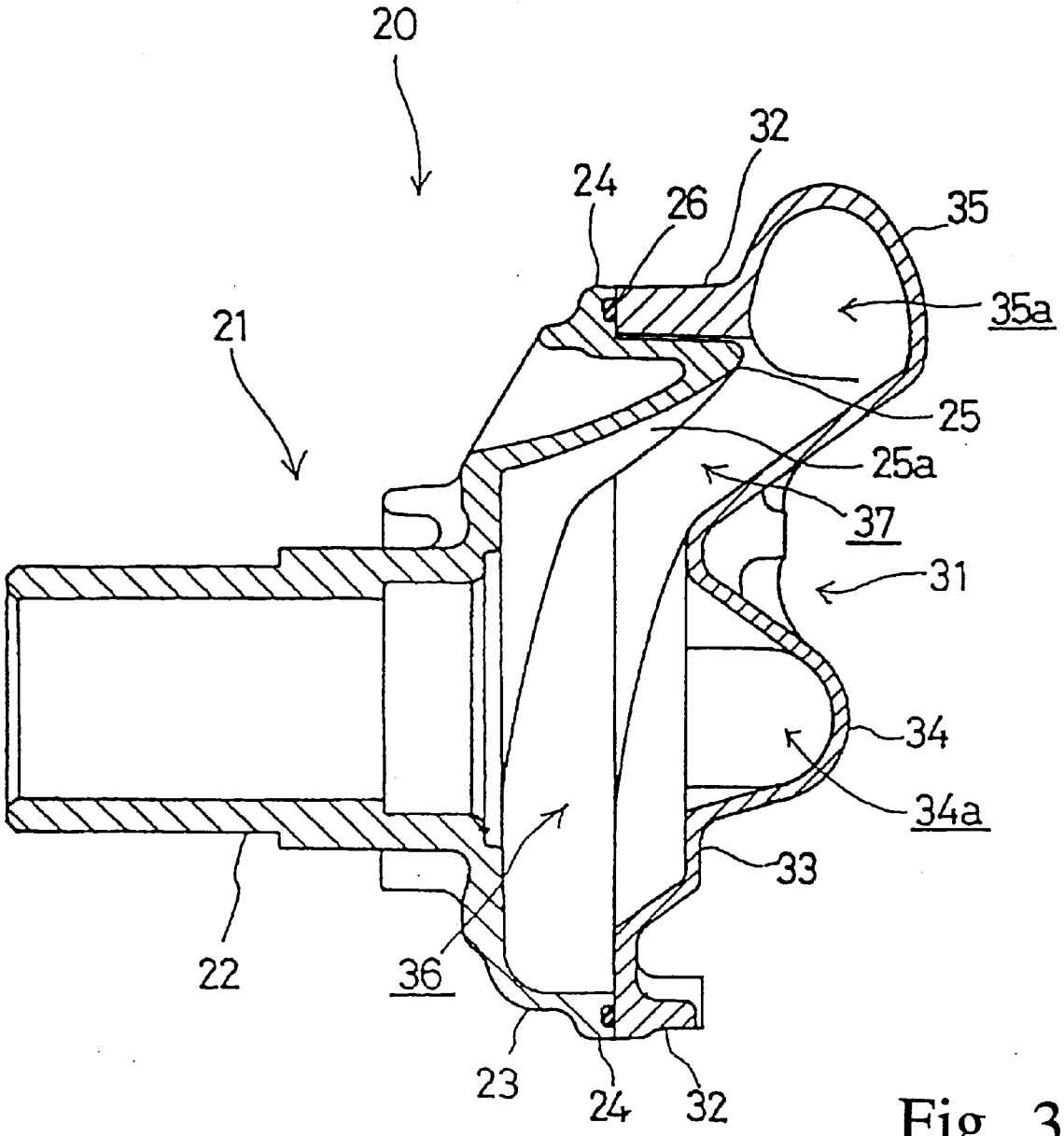
FIG. 3 is a sectional view of the water pump case taken along line III—III in FIG. 2.
Figure 4:
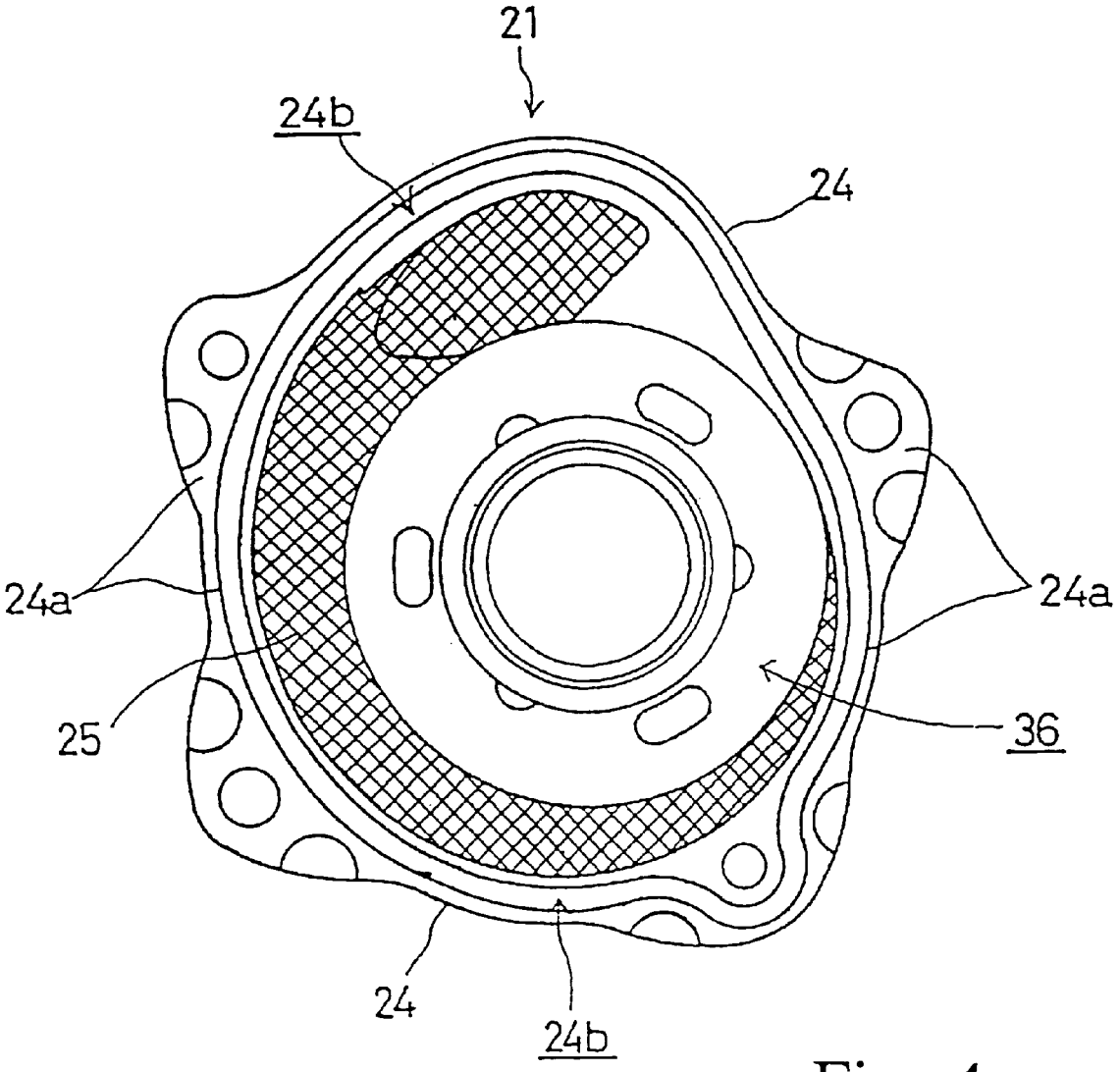
FIG. 4 is an interior view of the pump body.
Figure 5:
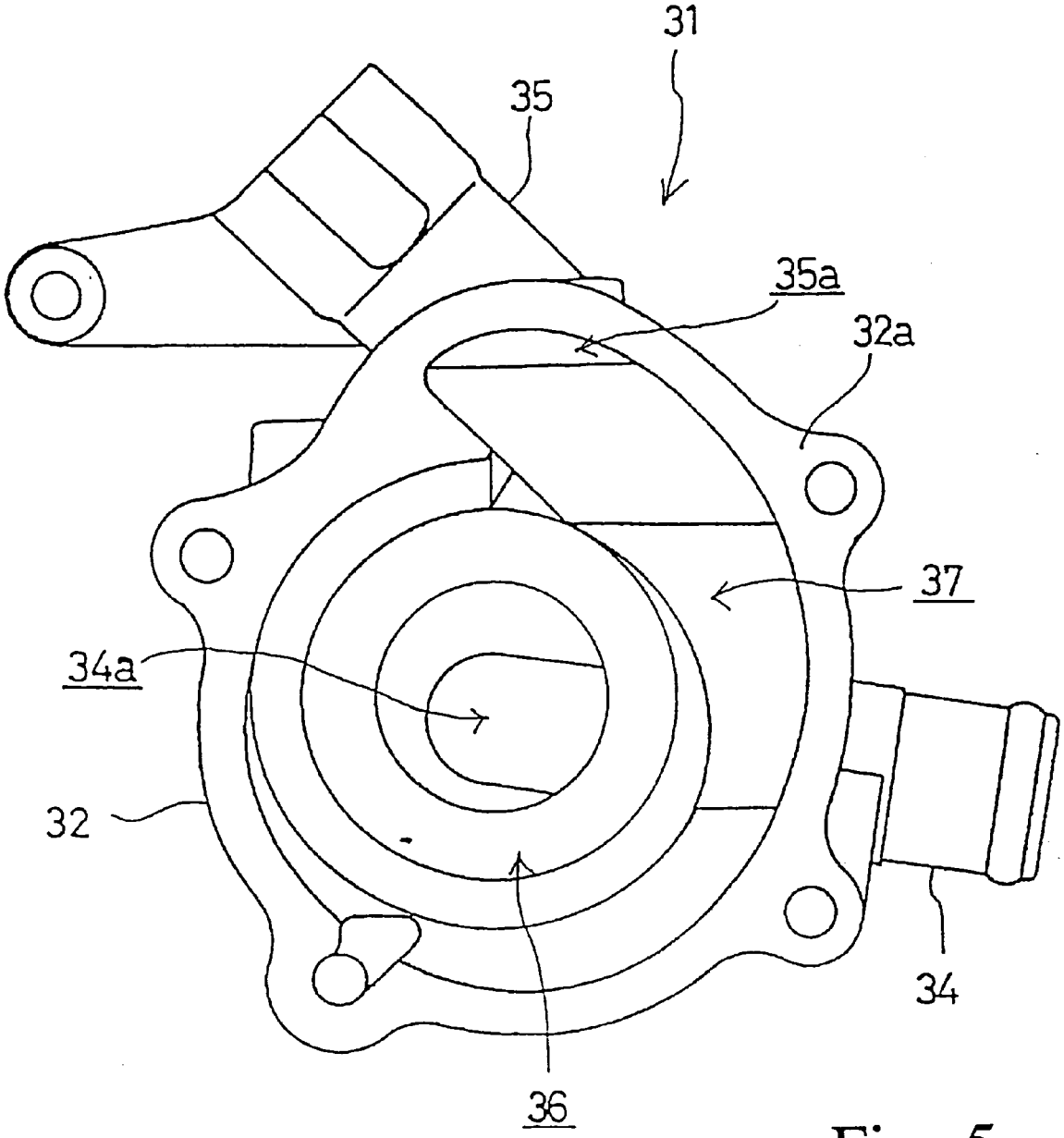
FIG. 5 is an interior view of the pump cover.

Referring to FIG. 3 and FIG. 4, an outer peripheral edge 24 of an opening in the bowl-like portion 23 forms a mating surface 24*a*. The mating surface 24*a* includes a groove 24*b* therein for fitting a sealing member 26 therein.

A projecting portion 25 (mesh portion shown in FIG. 4) is formed in an arcuately curved manner inside of the outer peripheral edge 24 of the bowl-like portion 23 and along the outer peripheral edge 24, and extends over at least half of the circumference of the bowl-like portion 23.

The projecting portion 25 is formed along the radially outer peripheral portion of the impeller 45.

As shown in FIG. 3, the side wall of the bowl-like portion 23 is recessed inwardly so as to project leftward beyond the mating surface 24*a* of the outer peripheral edge 24.

The pump cover 31 has an opening on its right-hand side, and has a mating surface 32*a* (see FIG. 5) on its outer peripheral edge 32 in corresponding relationship to the mating surface 24*a* on the outer peripheral edge of the pump body 21.

A suction pipe 34 extends forwardly from a central part of a side wall 33 of the pump cover 31, and is aligned with the pump axis. A discharge pipe 35 extends upwardly and obliquely rearwardly above the suction pipe 34.

When the pump cover 31 is fitted to the pump body 21, both a flat columnar space 36 for rotation therein of the impeller 45 and an outer peripheral space running along the outer periphery of the space 36 are formed within the interior space defined by the pump body and the pump cover. In the outer peripheral space, an arcuately curved inner peripheral wall 25*a* of the projecting portion 25 defines a cooling water guide passage 37.

Referring now to FIG. 6, the pump shaft 40 is rotatably supported by the cylindrical portion 22 of the pump body 21 through a bearing 41. Sealing members 42 and 43 are disposed on both right and left sides of the bearing 41. The impeller 45 is fitted on an end portion of the pump shaft 40 extending through the inner sealing member 43 and is accommodated within the columnar space 36.

A suction port 34*a* is formed in a base end portion of the suction pipe 34 so as to be positioned centrally (on the pump axis) of the impeller 45. A discharge port 35*a* is formed in a base end portion of the discharge pipe 35 and is located at a position offset leftward (rightward in FIG. 3) of the pump axis from the outer peripheral portion of the impeller 45.

As the pump shaft 40 rotates with operation of the internal combustion engine 6 and the impeller 45 rotates together with the pump shaft, the cooling water which has been cooled in the radiator 15 flows through the cooling water hose 16 and is sucked into the interior of the water pump 20 through the suction pipe 34. The water then flows from the suction port 34*a* toward the center of the impeller 45.

The cooling water which has thus flowed to the center of the impeller is then directed in a centrifugal direction by rotation of the impeller 45, and flows smoothly toward the discharge port 35*a* located at the offset position while being guided without causing disturbance by the cooling water guide passage 37 which is defined by the curved inner peripheral wall 25*a* of the projecting portion 25 in the foregoing outer peripheral space.

The cooling water is then discharged from the discharge pipe 35, passes through the cooling water hose 17, and is fed to the cylinder block of the internal combustion engine 6 for cooling.

By utilizing the structure including the projecting portion 25, the cooling water is calmly guided and flows smoothly to the discharge port located at the offset position. Thus, it is possible to increase the amount of cooling water discharged and improve the pumping performance.

Figure 7:
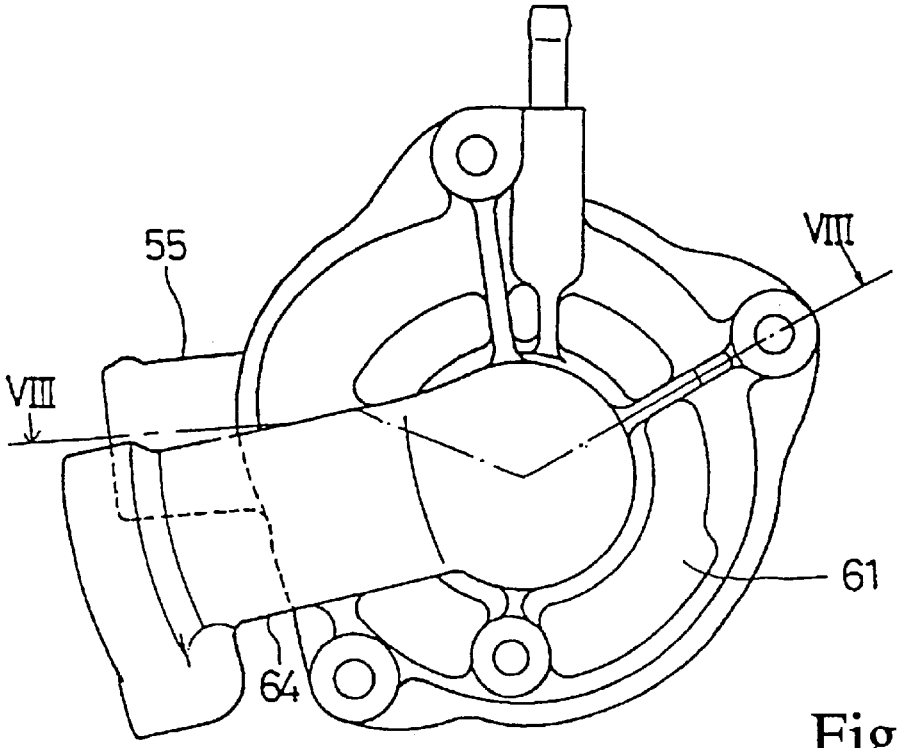
FIG. 7 is an end view of a water pump according to a second embodiment of the present invention.
Figure 8:
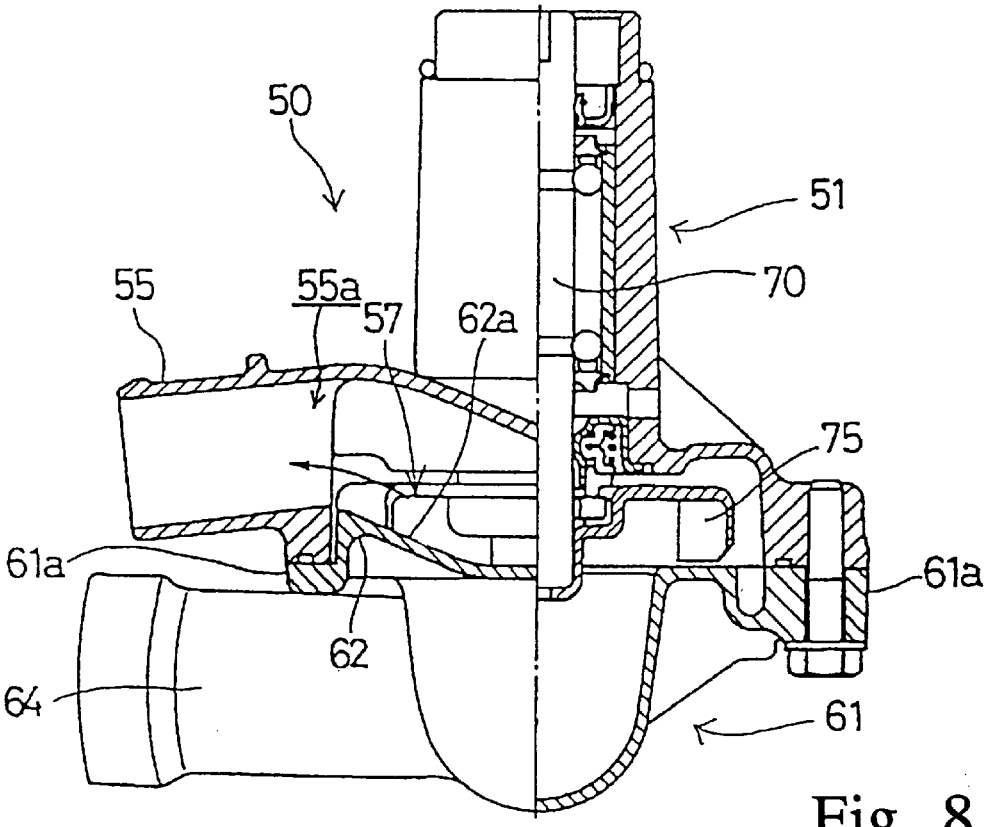
FIG. 8 is a partial sectional view taken along line VIII—VIII in FIG. 7.
Figure 9:
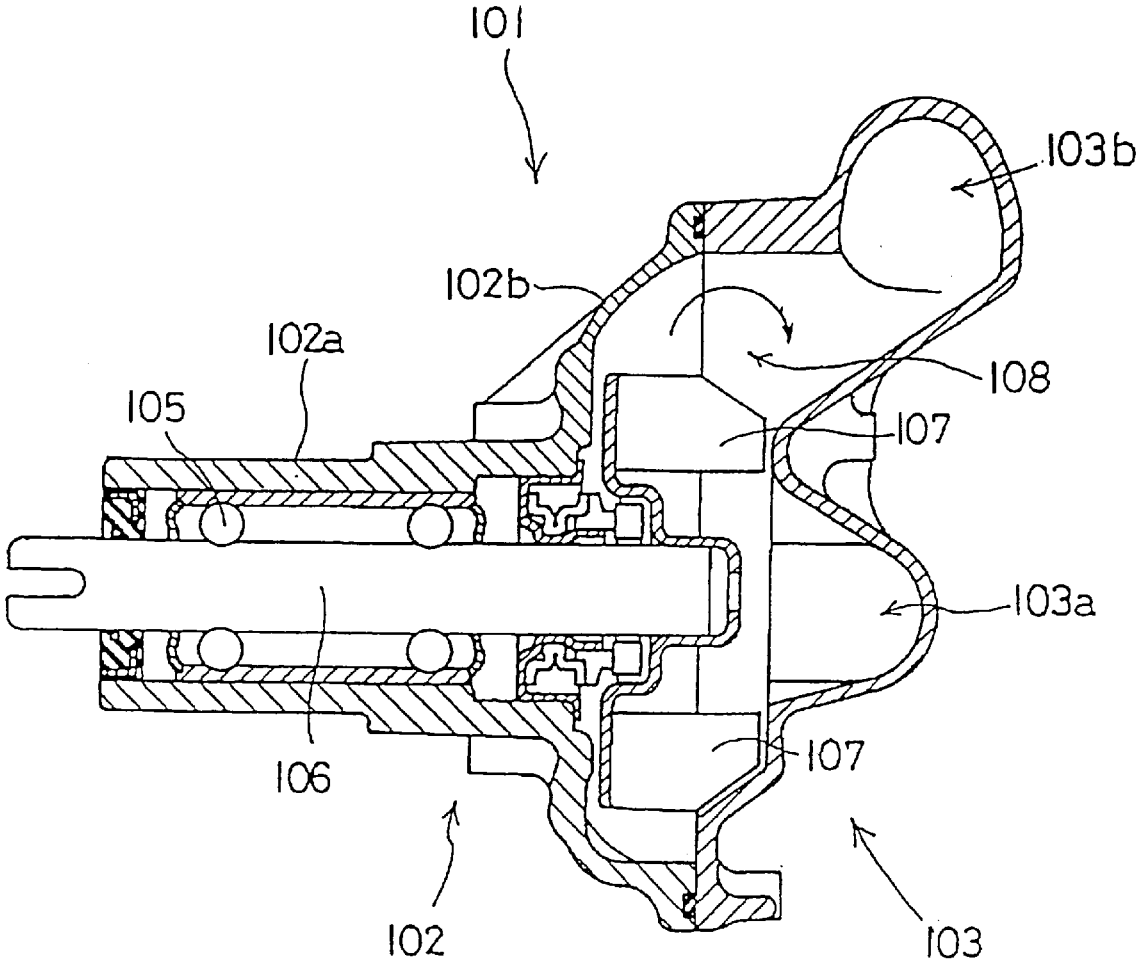
BACKGROUND ART Fig. 9
FIG. 9 is a sectional view of a water pump of the background art.

A second embodiment of the present invention will now be described below, with particular reference to FIGS. 7 and 8.

A water pump 50 according to the second embodiment has a pump case including a pump body 51 and a pump cover 61. Similarly to the first embodiment, a suction pipe 64 is formed on the pump cover 61. In the water pump 50, a discharge pipe 55 is formed on the pump body 51 substantially in the same direction as the suction pipe 64. A discharge port 55*a* is formed at a position offset in the axial direction of a pump shaft 70 from the outer peripheral portion of an impeller 75 and on the side opposite to the suction pipe 64.

An arcuately curved projecting portion 62 is formed inside and along an outer peripheral edge 61*a* of the pump cover 61.

An inner peripheral wall 62*a* of the projecting portion 62 defines a cooling water guide passage 57 in the space formed along the outer peripheral portion of the impeller 75. The guide passage 57 extends smoothly toward the discharge port 55*a*.

Consequently, cooling water directed in a centrifugal direction by rotation of the impeller 75 flows to the discharge port 55*a* located at the offset position smoothly without disturbance while being guided by the cooling water guide passage 57 which is defined in the foregoing outer peripheral space by the projecting portion 62. The cooling water is then discharged through the discharge pipe 55. Consequently, it is possible to increase the amount of cooling water discharged and thereby improve the pumping performance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A flow path structure in a fluid pump for feeding fluid by virtue of centrifugal force created by rotation of an impeller disposed within a pump case, with a cooling fluid discharge port being formed at a position offset in the axial direction of the pump from the outer peripheral portion of the impeller, said flow path structure including a projecting portion for smoothly guiding the cooling water to said discharge port from the outer peripheral portion of said impeller, wherein said pump case includes an inlet pipe, and a discharge pipe extending in substantially the same direction as the inlet pipe.

2. The flow path structure in a fluid pump according to claim 1, wherein said projecting portion has a gently curved side face.

3. The flow path structure in a fluid pump according to claim 1, wherein said pump case is split in half along the outer peripheral portion of said impeller to form a front half-shell and a rear half-shell.

4. The flow path structure in a fluid pump according to claim 3, wherein said projecting portion is formed on said rear half-shell adjacent to the outer peripheral portion of the impeller to define a flow path for guiding the fluid to said discharge port, and said discharge port is formed on the front half-shell.

5. The flow path structure in a fluid pump according to claim 1, wherein the projecting portion is spaced from an axis of rotation of said impeller by a distance which smoothly increases viewed in a direction of fluid movement from the impeller toward the fluid outlet.

6. The flow path structure in a fluid pump according to claim 1, wherein the fluid pump is a coolant pump for an internal combustion engine.

7. The flow path structure in a fluid pump according to claim 1, wherein the projecting portion is an arcuate member formed as a portion of a spiral.

8. The flow path structure in a fluid pump according to claim 1, wherein the projecting portion is an arcuate member spaced from a rotational axis of said impeller by a radius which continually increases as said projecting portion gradually progresses in an axial direction away from a plane of rotation of said impeller.

9. A fluid pump comprising:

a pump housing forming a fluid chamber therein, said fluid chamber having an impeller rotatable therein, said fluid chamber having a fluid inlet and a fluid outlet, said fluid outlet being axially offset from a circumferential peripheral portion of said impeller, said pump housing including a fluid redirecting wall member for smoothly redirecting fluid from the peripheral portion of said impeller toward the axially offset fluid outlet, wherein said pump housing includes an inlet pipe, and a discharge pipe extending in substantially the same direction as the inlet pipe.

10. The fluid pump according to claim 9, wherein the fluid redirecting wall member is spaced from an axis of rotation of said impeller by a distance which smoothly increases viewed in a direction of fluid movement from the impeller toward the fluid outlet.

11. The fluid pump according to claim 9, wherein the fluid pump is a coolant pump for an internal combustion engine.

12. The fluid pump according to claim 9, wherein the fluid redirecting wall member is an arcuate member formed as a portion of a spiral.

13. The fluid pump according to claim 9, wherein said fluid redirecting wall member gradually progresses in an axial direction away from a plane of rotation of said impeller.

14. The fluid pump according to claim 9, wherein the fluid redirecting wall member is an arcuate member spaced from a rotational axis of said impeller by a radius which continually increases as said fluid redirecting wall member gradually progresses in an axial direction away from a plane of rotation of said impeller.

15. The fluid pump according to claim 9, wherein said pump housing is split in half along the circumferential peripheral portion of said impeller to form a front half-shell and a rear half-shell.

16. The fluid pump according to claim 15, wherein said fluid redirecting wall member is formed on said rear half-shell adjacent to the circumferential peripheral portion of the impeller to define a flow path for guiding the fluid to said-fluid outlet, and said fluid outlet is formed on the front half-shell.

* * * * *